US005994261A

United States Patent [19]

Tai et al.

[11] Patent Number: 5,994,261

[45] Date of Patent: Nov. 30, 1999

[54] METHOD OF PRODUCING ACTIVATED CARBON FIBER

[75] Inventors: Kazuo Tai, Uji; Satoshi Kibe, Kashihara; Kazuaki Otsuki, Takarazuka; Norifumi Shindo, Kobe; Masaya Hashimoto, Kawai-cho; Yukihiro Ohtaguro, Uji; Yoshiiku Fujii, Yawata; Masanori Ohiwa, Okazaki, all of Japan

[73] Assignees: Ad'All Ltd., Uji; Unitika Ltd, Amagasaki; Osaka Gas Company Limited, Osaka, all of Japan

[21] Appl. No.: 07/935,259

[22] Filed: Aug. 27, 1992

[30] Foreign Application Priority Data

Aug. 28, 1991 [JP] Japan ..... 3-244488

[51] Int. Cl.[6] ..... B01J 20/02

[52] U.S. Cl. ..... 502/430; 423/447.6

[58] Field of Search ..... 423/447.6; 502/430

[56] References Cited

U.S. PATENT DOCUMENTS 4,921,686 5/1990 Yoshida et al. ..... 423/447.6

FOREIGN PATENT DOCUMENTS 57-25417 2/1982 Japan ..... 423/447.6
62-177217 8/1987 Japan .
022255516 10/1990 Japan .
1340069 12/1973 United Kingdom ..... 423/447.6

*Primary Examiner*—Michael Lewis
*Assistant Examiner*—Stuart L. Hendrickson
*Attorney, Agent, or Firm*—Pillsbury Madison & Sutro LLP

[57] ABSTRACT

A pitch-type fiber convertible to an activated carbon fiber is infusiblized with an infusiblizing gas and the infusiblized fiber is activated with an activating gas, such as steam, to produce an activated carbon fiber. The waste gas from the infusiblizing step is utilized in a combusting step. The combustible component of the waste gas from the activating step is separated out of the waste gas from the activating step and combusted in the combusting step along with the waste gas from the infusiblizing step. The resulting heat from the combusting step is utilized to preheat the infusiblizing gas and the activating gas and the preheated gases are utilized in the infusiblizing step and the activating step, respectively. This arrangement allows the infusiblizing temperature and the activating temperature to be accurately controlled. Thus, an activated carbon fiber is manufactured continuously without being negatively affected by waste gases from the infusiblizing and activating steps.

10 Claims, 3 Drawing Sheets

METHOD OF PRODUCING ACTIVATED CARBON FIBER

FIELD OF THE INVENTION

The present invention relates to a method of producing activated carbon fibers from pitch-type fibers convertible to activated carbon fibers.

BACKGROUND OF THE INVENTION

Activated carbon fibers are generally produced by a manufacturing sequence comprising a step of spinning a carbonaceous precursor material, such as pitch, to prepare a fiber aggregate, a step of infusiblizing the fiber aggregate to render it heat-resistant, and a step of activating the thus-infusiblized fiber aggregate to generate therein a multiplicity of micropores adapted to absorb various substances. Regarding the production technology for such activated carbon fibers, Japanese Patent laid open No. 255516/1990 discloses a method in which the spinning of pitch, and the infusiblization and activation of a carbon aggregate are performed in a continuous sequence.

In the above manufacturing technology and equipment for the production of activated carbon fibers, each of the constituent steps or stages is closely associated with the performance of the final activated carbon fiber. Therefore, the degree of treatment in any one stage has a profound influence on the subsequent stages and, hence, on the performance of the product activated carbon fiber. In other words, the conditions of treatment in each stage must be critically controlled.

Meanwhile, in the production of activated carbon fibers, the infusiblization and activation of the fiber aggregate are conducted at comparatively high temperatures and, therefore, may cause various problems. Thus, in order to control the infusiblization and activation temperatures, it is necessary to supply a thermal energy corresponding to the loss of heat due to dissipation and deprivation by the infusiblization and activation waste gases in the infusiblization and activation stages.

Japanese Patent laid open No. 177217/1987 discloses a infusiblizing furnace for infusiblizing continuously carbon fiber aggregate comprising a plurality of multistage gas permeable conveyers disposed in the horizontal direction within a furnace, which adjoining conveyers can be traveled in the traverse direction each other and the terminal ends of the adjoining conveyers are shifted by a predetermined distance in horizontal direction, walls for isolating the multistage conveyers and having a controlling mechanism for controlling a flow rate of ascending current, and a means for controlling a temperature of the multistage compartments independently. This literature also discloses that a preheated air may be supplied to the multistage compartments from the below portion of the furnace.

However, since the amount of such dissipated and deprived heat is fairly large, it is impossible to accurately control the treating temperatures in the infusiblization and activation stages by means of a burner or equivalent means. Moreover, in order to supply the thermal energy corresponding to said dissipated and deprived heat, it is necessary to install some other heat source but this entails a substantial additional capital investment.

Furthermore, when a pitch-type fiber is infusiblized, its tar fraction is vaporized. Pitch, in particular, has a tar fraction generally containing aromatic condensed polycyclic compounds with a broad molecular weight distribution so that it releases large quantities of tar. The tar fraction not only sticks to the internal surface of the infusiblizing unit but tends to plug the infusiblization waste gas pipeline. Moreover, since the tar fraction adversely affects the infusiblization reaction, the concentration of this fraction must be controlled below a certain critical value. In addition, if the infusiblization waste gas containing the tar fraction is exhausted from the system, contamination of the working area and ambient environment is inevitable.

Moreover, in the progress of activation, not only a tar fraction but a combustible mixed gas containing carbon monoxide, hydrogen, etc. is stoichiometrically produced. If the mixed gas is allowed to accumulate in the system, there may occur an explosion or, if it leaks out from the system, cause poisoning and pollution problems. Moreover, since the mixed gas exerts an adverse effect on the activation reaction, the concentration of the byproduct mixed gas must be controlled below a certain value.

Furthermore, in order to remove the tar fraction and combustible mixed gas, it is necessary to provide a collector means for trapping the tar components and an eliminating or treating device for disposal of the combustible mixed gas, with the result that the load on the plant is also increased.

SUMMARY OF THE INVENTION

It is, therefore, an object of the present invention to provide a method of producing activated carbon fibers which infusiblization temperature and/or activation temperature can be controlled precisely and insures efficient infusiblization and activation.

It is another object of this invention to provide a method of producing activated carbon fibers which permits infusiblization and activation without being adversely affected by infusiblization waste gas and/or activation waste gase.

It is still another object of this invention to provide a method of producing activated carbon fibers by which infusiblization and/or activation can be accomplished with improved thermal efficiency.

The method of this invention comprises infusiblizing a pitch-type fiber convertible to activated carbon fiber with an infusiblizing gas whereby an infusiblized fiber and waste infusiblizing gas are obtained, and activating the so-infusiblized fiber with an activating gas whereby an activated fiber and waste activating gas are obtained. At least one of the waste infusiblizing gas and the waste activating gas is combusted, and, with heat generated from the combusting, at least one of the infusiblizing gas and activating gas is preheated.

In the method of this invention, since the infusiblizing gas and/or the activating gas is preheated, the temperature variation in the course of infusiblization and/or activation is minimized and the fiber is infusiblized and/or activated with efficiency. Thus, the thermal efficiency of the system can be improved. Further, since the waste infusiblizing gas and/or the waste activating gas is combusted, the risk of environmental pollution can be decreased. Furthermore, the fiber can be infusiblized and/or activated without being adversely affected by the tar fraction and/or combustible mixed gas.

In one embodiment of the invention, the preheating heat is generated by combusting the waste gases from both the infusiblizing and activating steps. The heat generated from combusting is utilized to preheat at least one of the infusiblizing gas and activating gas in a preheating step. In this embodiment, the infusiblizing and activating gases can be preheated utilizing the large thermal energy available on combustion of the waste gases, and the dissipated and deprived heat can be made up for with the preheated gas, with the result that the thermal efficiency of the system can be further increased. Moreover, since the waste infusiblizing gas and the waste activating gas are combusted, the tar fraction and combustible mixed gas are disposed of to eliminate the risk of pollution, and the fiber can be infusiblized and/or activated efficiently without being adversely affected by the tar fraction and combustible mixed gas.

In still another embodiment, the both waste infusiblizing gas and the waste activating gas are combusted for preheating both the infusiblizing gas and activating gas in a preheating step.

The combustible component of the waste activating gas may be separated by a separating means and combusted in a combusting step. Since the combustible component yields a large combustion heat, this heat from combusting the combustible component is utilized to preheat at least one of the infusiblizing gas and the activating gas. Where the activating gas comprises steam, the combustible component can be easily separated from the waste activating gas by cooling the waste activating gas and subjecting it to gas-liquid separation.

The liquid separated by the separating means may be cooled, and, with the thus cooled and separated liquid is utilized to cool the waste activating gas.

When the waste infusiblizing gas is combusted in the combusting step in the presence of a catalyst, the tar and other fractions in the waste infusiblizing gas can be efficiently combusted.

It should be understood that the step in which a pitch fiber is heat-treated in the presence of oxygen to prevent fusion of individual filaments is known as infusiblization.

The above objects and advantages of the present invention will be better understood from the following detailed description, accompanying drawings, and experimental and comparative experimental examples.

DETAILED DESCRIPTION OF THE PREFERRED EMBODIMENTS

Figure 1:
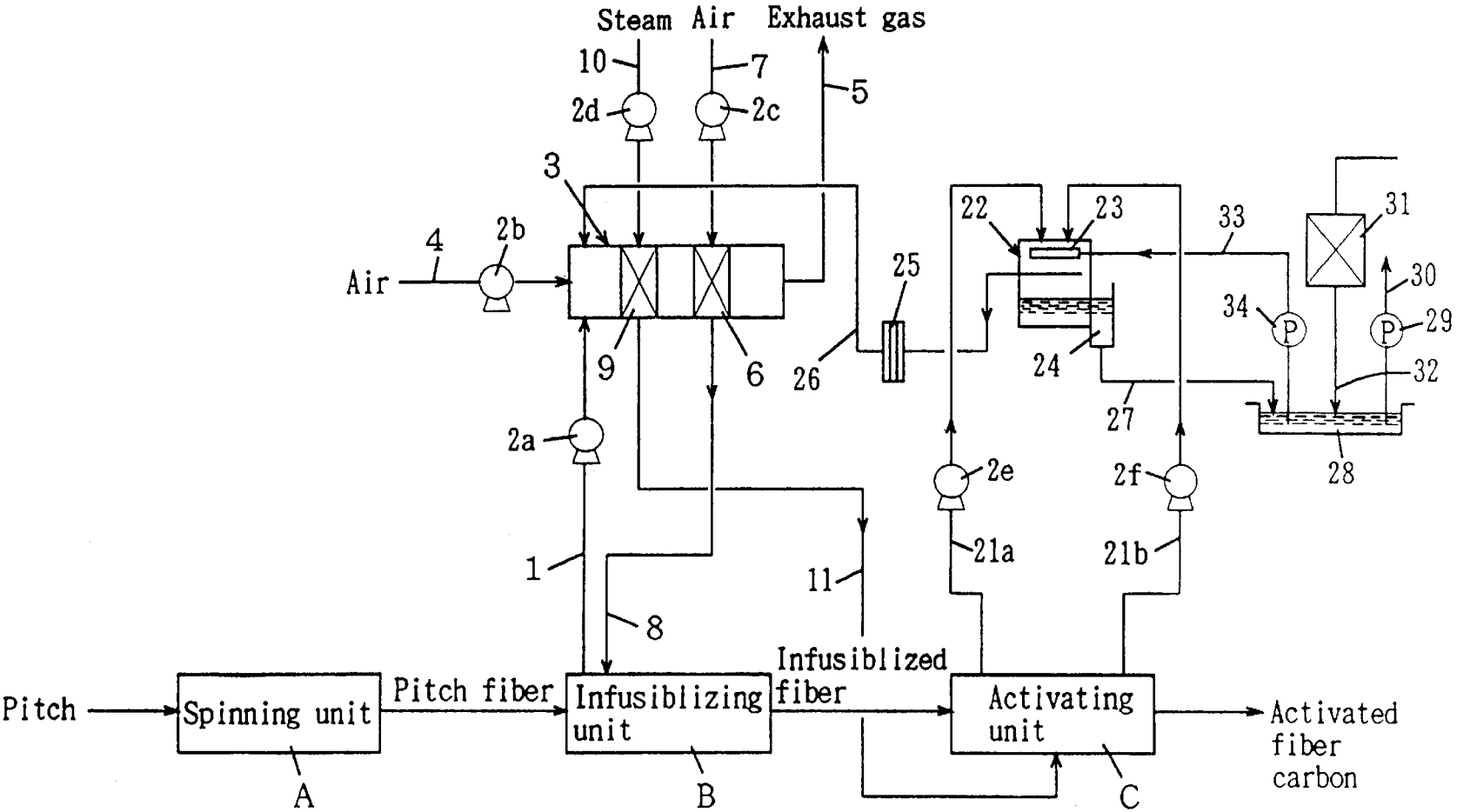
FIG. 1 is a schematic flow chart for illustrating production method of the invention.

Referring to FIG. 1, the production system for pitch-type activated carbon fiber comprises a spinning unit A for melt-spinning a pitch to form a fiber aggregate, an infusiblizing unit B for infusiblizing the fiber aggregate with an infusiblizing gas and an activating unit C for activating the so-infusiblized fiber aggregate with an activating gas.

The spinning unit A includes an extruder for melt-extruding a pitch for metered feed to a spinneret nozzle and a suction gun which is supplied with a compressed gas. The molten pitch fed to the spinneret nozzle is continuously discharged from the nozzle to form molten threads, the molten threads are taken up under suction by the suction gun supplied with a compressed gas to form monofilaments, and the monofilaments are laid on a conveyance means comprising a first conveyer for the formation of a fiber aggregate.

The pitch mentioned above includes, for example, optically isotropic pitch, coal-based pitch, petroleum-based pitch and so on. The softening point of the pitch is, for example, about 180 to 330° C. Moreover, the toluene-insoluble fraction of the pitch is about 40 to 90 weight % and the quinoline-insoluble fraction thereof is about 3 to 60 weight percent. The extruder temperature for heating the pitch may be higher than the softening point of the pitch by about 40 to 80° C.

The preferred gas to be supplied to the suction gun is air but there is no particular limitation on the type of gas. In the spinning stage, monofilaments are produced as the pitch passes through a spinneret nozzle having a number of orifices of about 50 to 1,500, the diameter of which may range from 200 to 700 $\mu$m.

The spun fiber may be a short-staple fiber or a long-staple fiber. The diameter of monofilaments may vary widely in the range of about 5 to 500 $\mu$m but is generally about 10 to about 30 $\mu$m. The fiber aggregate may, for example, be a web or sheet weighing about 50 to 2,000 g/m$^2$. It may likewise be a short-staple sliver, a long fiber tow or hank, for instance. The weight of the fiber aggregate may for example be not greater than 2,000 g/m$^2$ and preferably about 50 to 1,000 g/m$^2$. The weight of the fiber aggregate can be controlled by adjusting the rate of discharge of molten pitch, the travelling speed of the first conveyer and other machine settings.

The fiber aggregate on the first conveyer is transferred, by another conveyance means comprising a second conveyer, to the infusiblizing unit B, where it is infusiblized. This infusiblization can be achieved by heat-treating the fiber aggregate with an infusiblizing gas supplied via a supply line 8.

The infusiblizing gas includes, for example, air and other oxidizing gases such as oxygen, $NO_x$, $SO_x$, ozone and other gases inclusive of mixtures thereof. The preferred infusiblizing gas comprises air.

The infusiblization reaction primarily comprises partial oxidation (solid-gas reaction) and dehydrogenating polycondensation (solid phase reaction). Therefore, penetration of the infusiblizing gas into the fiber aggregate, surface renewal at the reaction site, and uniform heating are essentially required. For efficient surface renewal at the reaction sites and uniform heating, it is preferable that the infusiblizing gas be blasted against the fiber aggregate from the face and reverse sides of the second conveyer.

The infusiblizing unit B comprises a plurality of, for example about 5 to 20, compartments (not shown) each isolated from the external atmosphere and supplied with a gas preheated by a heating means, such as a heater or a burner, and circulated by a blower. The temperature of the plurality of compartments in the infusiblizing stage varies from about 200° C. in the compartment closest to the spinning unit A to about 350–500° C. in the compartment closest to the activating unit C. Thus, the respective compartments constituting the infusiblizing unit B are preset to gradually increasing temperatures in the direction of conveyance of the fiber aggregate. Thus, the fiber aggregate is heat-treated as it passes through these compartments in succession and a heat-resistant and stable infusiblized fiber aggregate is obtained at the conveyance terminal end of the infusiblizing unit B.

The temperature gradient in the infusiblizing stage can be freely selected only if the object of infusiblization is not frustrated. Generally, the temperature profile should be ascending progressively in the direction of conveyance of the fiber aggregate in the range of from a temperature of not higher than the softening point of the pitch to a temperature of not lower than the softening point of the pitch and of the final infusiblization temperature. The internal temperature of each compartment is preferably controlled with a programmed controller so as to optimize the extent and time of infusiblization.

The infusiblizing unit B can be constructed in any suitable configuration, e.g. in the manner of a conventional continuous infusiblizing furnace, tunnel-type continuous infusiblizing furnace or a rotary kiln-type continuous infusiblizing furnace.

The fiber aggregate conveyed by the second conveyer and infusiblized in the infusiblizing stage is taken up by a third conveyer. In the activating unit C, the fiber aggregate is activated by the activating gas supplied through the supply line 11 to give an activated carbon fiber. The activating unit C may also comprise a plurality of compartments through which the infusiblized pitch fiber aggregate may be transported.

The activating gas includes, for example, such activators as steam, oxygen gas, carbon dioxide gas, etc. as well as various mixtures thereof. The preferred activating gas at least contains hot steam. Since the activating reaction is a solid-gas reaction between the infusiblized pitch fiber aggregate and the activating gas, an efficient passage of the activating gas through the infusiblized pitch fiber aggregate, constant surface renewal at the reaction site, and uniform heating are essentially required. The activating temperature is generally about 700 to 1,200° C. and can be selected according to the quality and productivity of activated carbon fiber. As it is the case with the infusiblizing unit B, the activating unit C can be constructed in any optional configuration, e,g. in the manner of a conventional continuous activating furnace, a tunnel type continuous activating furnace or a rotary kiln type continuous activating furnace.

In the above infusiblizing stage, an infusiblization waste gas containing a tar fraction, which is a low-boiling fraction, is evolved with the progress of infusiblization. In the activating stage, an activation waste gas containing a combustible gas component is evolved with the progress of activation. The tar component of the infusiblization waste gas and the combustible gas component of the activation waste gas bring about various disadvantages as mentioned hereinbefore.

Therefore, the infusiblization waste gas generated in the infusiblizing stage is fed to a combusting unit 3 through a feed line 1 provided with a blower 2*a*. The activation waste gas evolved in the activating stage is subjected to gas-liquid separation in a separating unit 22 and the combustible component so separated is fed to the combusting unit 3 through a feed line 26.

In more detail, the activation waste gas generated in the activating stage is fed to the separating unit 22 through feed lines 21*a* and 21*b* connected to both ends of the activating unit C. In this separating unit 22, the activation waste gas is cooled and the condensed fraction, such as water vapor, of the activation waste gas is separated from the combustible uncondensed gases such as carbon monoxide gas, hydrogen gas, etc. Thus, the separating unit 22 comprises a scrubber including a shower 23, a liquid basin disposed below and a tank 24 for pooling overflows from the liquid basin. Collected in the basin is the condensable component of activation waste gas which has been condensed by a jet of water from the shower 23.

Usually, solid particles such as dust fiber are generated in association with the activation treatment. In such cases, the dust is trapped by the showered water and precipitates in the liquid basin, and the supernatant collects in the tank 24.

The construction of the scrubber as a gas-liquid separating means is not limited to the illustrated construction. Thus, the activation waste gas may be fed to the separating unit from below so that it may contact in counter-current with a sprayed water supplied from above. The scrubber may also be a spray tower, a cyclone, a venturi device or the like. Moreover, it may be so arranged that the waste water containing dust will be withdrawn from the bottom of the basin.

The gas phase containing a combustible component as separated in the separating stage is fed to the upstream end of the combusting unit 3 through a feed line 26 equipped with a filter 25, and the carbon monoxide, hydrogen and other combustible components of the activation waste gas are combusted. Connected to the upstream end of the combusting unit 3 is an air feed line 4 having a blower 2*b* for supplying air to the infusiblization waste gas.

In the combusting unit 3, air is mixed with the infusiblization waste gas and the combustible component of the activation waste gas, and the resulting mixture is combusted. The hot products of combustion in the combusting unit 3 are exhausted via a waste gas line 5.

Disposed downstream of the combusting unit 3, that is to say the low temperature side of the combusting stage, is a preheating unit 6 provided with a preheating pipe. The preheating pipe is supplied with an infusiblizing gas, such as air, through an infusiblizing gas feed line 7 equipped with a blower 2*c*. This infusiblizing gas is preheated by the hot products of combustion from the combusting unit 3 and fed to the infusiblizing unit B through a feed line 8.

A preheating unit 9 equipped with a preheating pipe is disposed upstream of the combusting unit 3, i.e. on the high temperature side of the combusting stage. To the preheating pipe is connected an activating gas feed line 10 having a blower 2*d* for supplying steam as the activator. The activating gas fed to the preheating pipe is preheated by the hot products of combustion of the combustible component from the combusting stage and fed to the activating stage through a feed line 11. For a uniform distribution of heat, the activating unit C is provided with a fan.

As the activation reaction is carried out at elevated temperature, the temperature of the liquid in the liquid basin and tank 24 increases gradually. Therefore, the water collected in the water tank 24 of the separating unit 22 is fed to a water storage means 28 through a feed line 27. The water in this water storage means 28 is fed to a heat exchanger 31 through a feed line 30 provided with a pump 29, and the cooled water in this heat exchanger 31 is fed to the water storage means 28 through a circulating line 32. Therefore, the water in the water storage means 28 is maintained at a substantially constant temperature. Overflows from the water storage means 28 are fed to a waste water disposal system.

The cooling water in the water storage means 28 is fed to the water shower 23 through a circulating line 33 equipped with a pump 34 and reused for the separation of combustible components from the activation waste gas.

In the production method using the above equipment, the hot products of combustion of the infusiblization and activation waste gases in the combusting stage can be effectively utilized for preheating the infusiblizing and activating gases. Moreover, by feeding the preheated infusiblizing gas to the infusiblizing stage in the infusiblizing unit B and the preheated activating gas to the activating stage in the activating unit C, the loss of heat due to dissipation and deprivation in the infusiblizing and activating stages can be made up for successfully. Therefore, it becomes possible to increase the heat efficiency in the infusiblizing stage and activating stage, control the temperatures of the infusiblizing stage and activating stage with high accuracy, and infusiblize and activate the fiber aggregate continuously and with good efficiency, thus enabling a continuous production of high-quality activated carbon fiber.

Moreover, since the activating gas is preheated in a high temperature zone of the preheating unit 9 disposed upstream of the combusting unit 3 and the infusiblizing gas is preheated in a low temperature zone of the preheating unit 6 disposed downstream of the combusting unit 3, the activating gas can be preheated to a temperature higher than that of the infusiblizing gas in accordance with the heating temperatures of the activating stage and infusiblizing stage.

Furthermore, since the tar component of the infusiblization waste gas and the combustible toxic gas component of the activation waste gas can be combusted in the combusting stage, the risk of environmental pollution due to the tar fraction and activation waste gas can be eliminated.

In the present invention, the spinning stage is not essential because a prespun fiber can be fed to the infusiblizing and activating stages. However, for continuous production of activated carbon fibers, the spinning stage is preferably provided within a production line comprising the infusiblizing and activating stages.

The present invention is preferably applied, with particular advantage, to the manufacture of pitch-type activated carbon fiber which gives rise to large amounts of tar and combustible components. As to the spinning method for pitch materials, the conventional technology can be employed according to the kind of pitch-type precursor fiber. Thus, for example, the above-mentioned method comprising extruding a molten raw material from a nozzle with drawing to prepare mono-filaments, the airjet spinning method comprising dispersing a molten raw material with air streams to prepare fibers, the centrifugal spinning method comprising spinning a molten raw material in a centrifugal field, the wet spinning method and the dry spinning method can be selectively employed.

In the present invention, at least one of the infusiblizing gas and activating gas is preheated in the preheating stage by utilizing the combustion heat from the combusting stage for combusting the infusiblization and/or activation waste gas. Preferably, for improved heat efficiency, both of the infusiblizing gas and the activating gas are preheated in the preheating stage. The caloric value of the combustible component of the activation waste gas is large. Therefore, it is preferable to utilize at least the hot products of combustion of the combustible component of activation waste gas having such a large caloric value for the preheating of the infusiblizing gas and/or the activating gas. Particularly when the hot products of combustion of the combustible component of the activation waste gas and the infusiblization waste gas are utilized, the infusiblizing and activating gases can be preheated with a considerable heat.

Figure 2:
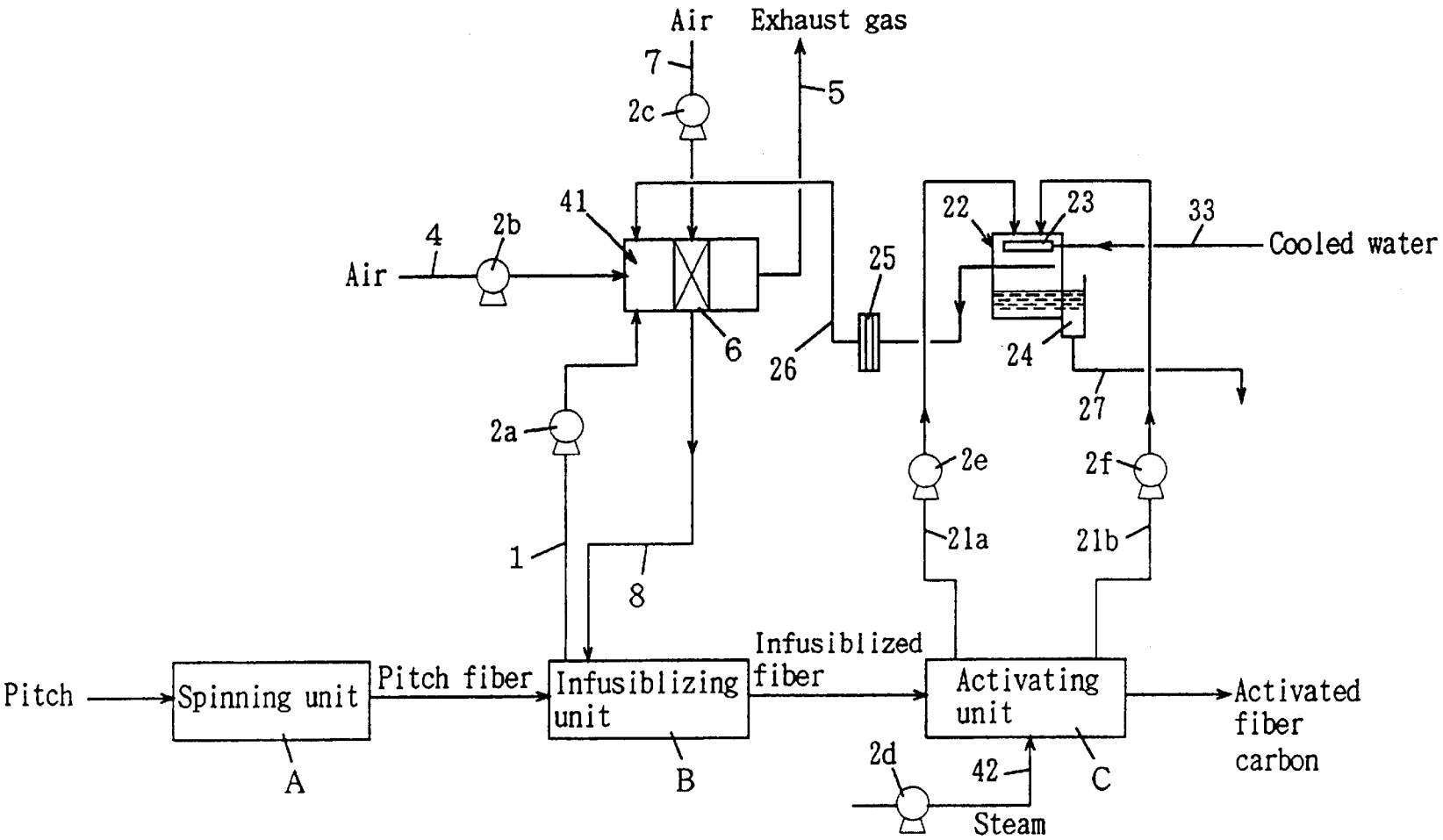
FIG. 2 is another flow chart for explaining another method of the invention.

FIG. 2 is a schematic flow chart for explaining another method of the invention. In the following description, the like numerals are used to indicate the like parts of the preceding embodiment.

In this method, the activating gas is not preheated and the infusiblizing gas is preheated with the heat of combustion of the infusiblization and activation waste gases. Thus, the infusiblization waste gas produced in the infusiblizing unit B is fed to a combusting unit 41 through a feed line 1. Steam, as the activating gas, is fed to an activating unit C through a line 42. The combustible component of the activation waste gas which is available from the activating stage is subjected to gas-liquid separation in a separating unit 22*a* and the gas is supplied to the combusting unit 41 through a feed line 26. For supplying air to the infusiblization waste gas, an air feed line 4 is connected to this combusting unit 41.

As in the preceding embodiment, the combusting unit 41 is provided with a preheating unit 6 equipped with a preheating pipe. The preheating pipe is supplied with an infusiblizing gas through a feed line 7. The infusiblizing gas thus supplied is preheated by hot products of combustion from the combusting unit 41 and fed to the infusiblizing unit B through a feed line 8.

Figure 3:
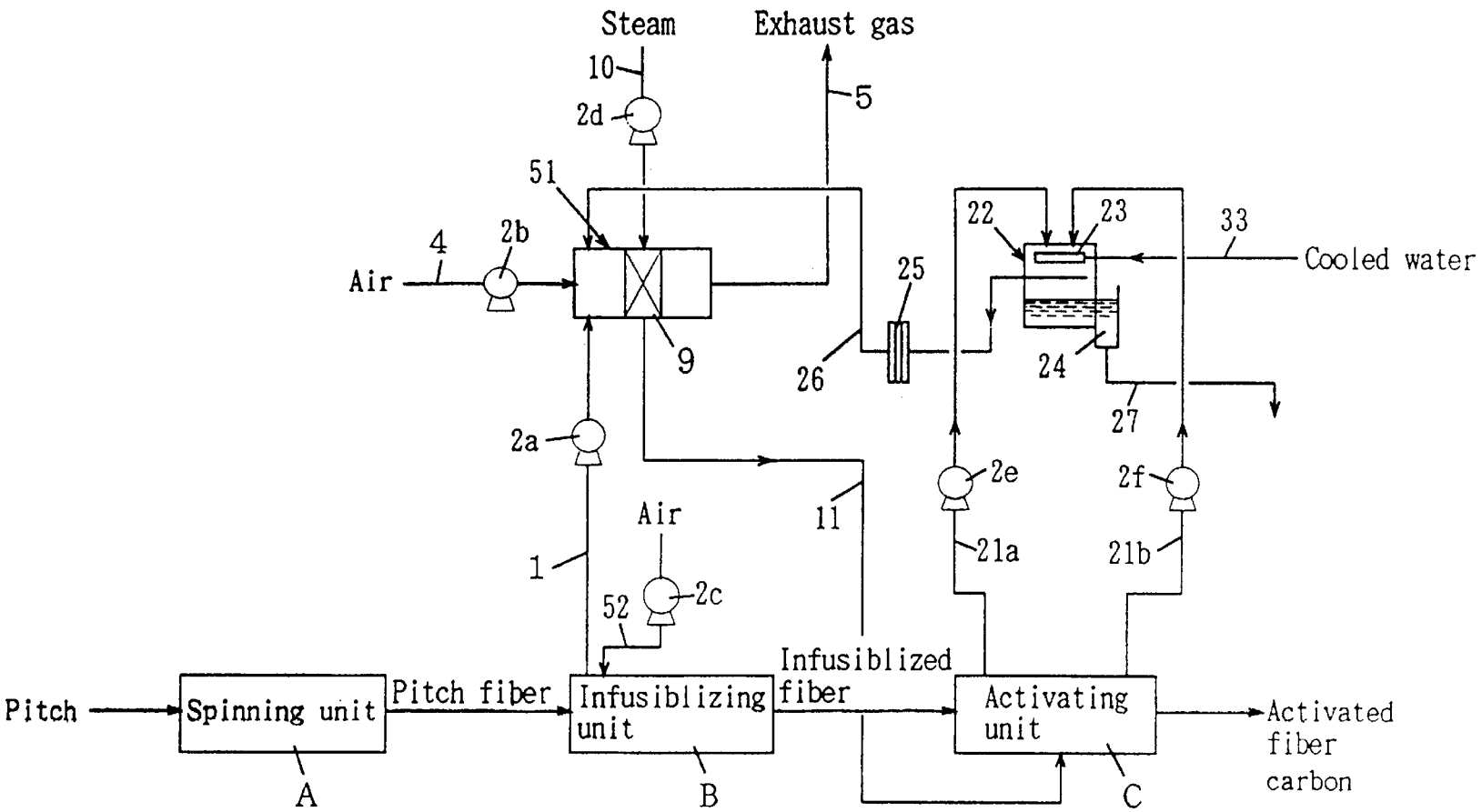
FIG. 3 is a still another flow chart for explaining still another method of the invention.

FIG. 3 is a flow sheet for explaining still another method of the invention.

In this method, contrary to the method described with reference to FIG. 2, without preheating the infusiblizing gas, the activating gas is preheated with the heat of combustion of the infusiblization and activation waste gases. Thus, air as the infusiblizing gas is supplied to the infusiblizing unit B through a supply line 52. The infusiblization waste gas generated in the infusiblizing stage is fed to a combusting unit 51 through a supply line 1. The activation waste gas generated in the activating stage is fed to a separating unit 22*a* where a condensate is separated from an uncondensed gas containing combustible components such as carbon monoxide, hydrogen, etc. The gas phase in the separating stage is fed to the combusting unit 51 through a feed line 26 provided with a filter 25. The hot products of combustion in the combusting stage are used for the preheating of the activating gas in the preheating stage.

When the combustible component of the activation waste gas generated in the activating stage and the tar component of the infusiblization waste gas are combusted together, the infusiblization waste gas is preferably supplied to the vicinity of the combustion flame of the activation waste gas. When the infusiblizing gas is preheated without utilizing the heat of combustion of the combustible component of the activation waste gas, the combustion of the tar fraction of the infusiblization waste gas has to be generally carried out in a comparatively high temperature region of not less than 650° C. However, when the combustion is carried out in the presence of a catalyst, such as a platinum group metal catalyst or a manganese oxide type catalyst, it is possible to decompose and combust the tar component of the infusiblization waste gas at a temperature of about 300 to 400° C. Where all the caloric value necessary for the preheating of infusiblizing gas cannot be obtained from the heat of combustion of activation and infusiblization waste gases, the heat of combustion of town gas, propane gas, heavy oil, coal or the like can be utilized. The infusiblization waste gas and/or the activation waste gas is generally combusted at a complete-combustion temperature.

The separating stage may be of any suitable construction, and is not limited to the one described above, only if it is capable of separating the combustible component from the activation waste gas generated in the activating stage. However, steam is generally used as the activating gas and, then, the activation waste gas can be cooled and subjected to gas-liquid separation to easily separate the water vapor and combustible gas as a condensate. The activation waste gas can be subjected to gas-liquid separation at least in one separating stage.

Instead of being fed to such a separating stage, the activation waste gas may be fed directly to the combusting stage for combustion. Moreover, the heat exchanger for cooling the liquid separated by the separating means is not necessarily indispensable. Furthermore, the shower need not be supplied with the water cooled by the heat exchanger but may be supplied with cooling water from an independent source. The liquid separated in the separating stage may be directly drained to a waste water disposal system.

As mentioned above, this specification also discloses a equipment for producing activated carbon fibers which comprises an infusiblizing unit for infusiblizing a pitch-type precursor fiber convertible to an activated carbon fiber with an infusiblizing gas, an activating unit for activating the infusiblized fiber with an activating gas, a combusting unit for combusting at least one of waste gas from the infusiblizing unit and activating unit, and a preheating means for preheating at least one of the infusiblizing gas and activating gas with heat generated in said combusting unit.

The preferred equipment is provided with a combusting unit for combusting at least activation waste gas having a large caloric value. Furthermore, the equipment preferably has a combusting unit for combusting the waste gas from the infusiblizing unit and the activating unit and a preheating unit for preheating at least one of the infusiblizing gas and the activating gas with heat generated in said combusting unit.

Moreover, the preferred equipment is provided with a preheating unit for preheating the infusiblizing gas and activating gas. Also preferred is a equipment for producing an activated carbon fiber which further comprising a separating means for separating the combustible component from the waste gas generated in the activating unit, a combusting unit for combusting the separated combustible component, and a preheating unit for preheating the infusiblizing gas and/or the activating gas by utilizing the combustion heat in the combusting unit. In this equipment, preferably the activating gas is steam, and the separating means is a gas-liquid separating means for cooling the activation waste gas from the activating unit and for separating a gas component contained in the activation waste gas from a liquid component. The preferred equipment has a heat exchange means for cooling the liquid separated by said separating means and a recycling line for recycling the liquid cooled by said heat exchange means to said separating means.

Moreover, the above equipment is preferably provided with a combusting unit for combusting the waste gas from the infusiblizing stage in the presence of a catalyst.

The activated carbon fiber produced in accordance with the present invention can be used advantageously in the field of absorbent materials for recovery or elimination of organic solvents, useful substances, malodors, etc. as well as in the field of electrodes, electronic materials and so on.

EXPERIMENTAL EXAMPLES

Experiment 1

A coal-type pitch (Mettler softening point 280° C.) was extruded by a melt-extruder (capacity 10 kg/hr), and the extruded fibers were drawn by a spinning machine and a suction-type drawing machine to prepare a web (weight 500 g/m$^2$) of long fibers having a monofilament diameter of about 20 $\mu$m.

The above web was continuously fed to a 12-zone conveyer-type continuous infusiblizing furnace having an effective length of 15 m for infusiblization. The temperature of this infusiblizing furnace was heated stepwise to about 200–400° C. with the heat of gas combustion, and the hot air was circulated in each zone. As the infusiblizing gas, air preheated to about 300° C. was continuously blasted against the face and reverse sides of the conveyer. Then, to preclude condensation of the tar fraction, a predetermined amount of the furnace gas composed of the volatile matter generated in the furnace and the heated air was supplied through the waste gas pipe to the combusting unit, where it was combusted and made harmless, while the air to be supplied to the infusiblizing furnace was preheated with the resulting heat of combustion in the preheating unit.

In this manner, a homogeneous infusiblized fiber could be stably obtained.

Comparative Experiment 1

The infusiblization of a web was carried out in the same manner as Example 1 except that the air was not preheated and the waste gas was exhausted from the infusiblizing furnace through the pipe.

The calorie fed to the infusiblizing furnace, the concentration of the tar fraction in the waste gas and the characteristics of the resulting infusiblized fiber were determined. The results are shown in Table 1.

In Experiment 1, the calorie fed to the infusiblizing furnace was $20.1\times10^4$ kcal/hr and the strength of the fiber was 5.5 kg/mm$^2$. In Table 1, the results of Comparative Experiment 1 are shown in terms of relative values, with each of the calorie fed, the amount of solvent extractibles and the strength of the fiber in Experiment 1 being taken as 1. Regarding the amount of solvent extractibles, the infusiblized fiber was extracted with a solvent (1,3-dimethyl-2-imidazolidinone), the absorption maximum at 420 nm was spectrophotometrically measured and the result was compared between the two experiments.

TABLE 1

| | Experiment 1 | Comparative Experiment 1 |
|---|---|---|
| Relative calorie fed | 1 | 2.42 |
| Concentration of tar in waste gas (mg/Nm$^3$) | ≦2 | 640 |
| Relative amount of extractibles | 1 | 1.25 |
| Relative fiber strength | 1 | 0.82 |

Experiment 2

The infusiblized web obtained in Experiment 1 was continuously fed to a conveyer type continuous activating furnace heated at about 900° C. for activation to give an activated carbon fiber. As the activating gas, preheated steam was continuously fed to the furnace so as to establish a uniform temperature distribution within the furnace. The waste gas composed mostly of carbon monoxide and hydrogen as generated by the activation reaction was fed though the pipe to the combusting unit for combustion to make it harmless. Moreover, the heat of combustion in the combusting unit was used in the preheating unit to preheat the steam to be fed to the activating furnace.

In the above manner, an activated carbon fiber could be stably obtained.

Comparative Experiment 2

The same activation procedures as Experiment 2 were carried out except that the steam was not preheated in the preheating unit and the waste gas from the activating gas was exhausted through the pipe.

The calorie fed to the activating furnace and the concentration of the combustible components (carbon monoxide and hydrogen) in the waste gas were determined. The results are shown in Table 2. In Experiment 2, the calorie fed to the activating furnace was $116.3\times10^4$ kcal/hr. In Table 2, the result of Comparative Experiment 2 is shown in terms of relative value with the calorie fed in Experiment 2 being taken as 1. The specific surface area of the activated carbon fiber obtained in Experiment 2 was 1,500±100 $m^2/g$.

TABLE 2

| | Experiment 2 | Comparative Experiment 2 |
|---|---|---|
| Relative calorie supplied | 1 | 1.40 |
| Concentration of combustible components in waste gas (volume %) | Trace | 12.9 |

Experiment 3

The procedures of Experiments 1 and 2 were repeated in a continuous sequence. Moreover, the waste gas from the infusiblizing furnace and the waste gas from the activating furnace were fed through the pipes to the combusting unit for combustion to make them harmless. By utilizing the heat of combustion in the combusting unit, the air to be fed to the infusiblizing furnace and the steam to be fed to the activating furnace were preheated in the preheating unit.

Comparative Experiment 3

The same infusiblization and activation procedures as Experiment 3 were repeated except that the air and steam were not preheated in the preheating units and the waste gases from the infusiblizing furnace and the activating furnace were exhausted through the respective pipes.

The amount of heat supplied to the activating furnace and the concentration of combustible components (carbon monoxide and hydrogen) in the waste gas were determined. The results are shown in Table 3. The amount of heat supplied to the activating furnace in Experiment 3 was $136.4\times10^4$ kcal/hr and the strength of the fiber was 14.5 $kg/mm^2$. Table 3 shows the results of Comparative Example 3 in relative terms with the calorie and fiber strength values found in Experiment 3 being taken as 1. The specific surface area of the activated carbon fiber obtained in Experiment 3 was 1,500±100 $m^2/g$.

TABLE 3

| | Experiment 3 | Comparative Experiment 3 |
|---|---|---|
| Relative calorie supplied | 1 | 1.55 |
| Concentration of combustible components in waste gas ($mg/Nm^3$) | ≦1.3 | 420 |
| Relative fiber strength | 1 | 0.89 |

Experiment 4

In the procedures of Experiments 2 and 3, the waste gas produced in the activating furnace was subjected to gas-liquid separation in the separating unit having a scrubber and the water vapor in the waste gas was removed as the condensate. The uncondensed gas was fed to the combusting unit for combustion and the steam to be fed to the activating furnace was preheated with the resulting heat of combustion. This procedure provided for 25% of the total heat requirements of the activating furnace.

What is claimed is:

1. A method of producing an activated carbon fiber comprising the steps of:

(a) infusiblizing a pitch fiber convertible to an activated carbon fiber with an infusiblizing gas whereby an infusiblized fiber and waste infusiblizing gas are obtained, (b) activating the infusiblized fiber with an activating gas whereby an activated fiber and waste activating gas are obtained, (c) treating the waste activating gas to separate out a combustible component therefrom, (d) combusting at least one of said waste infusiblizing gas and said combustible component, and (e) preheating the infusiblizing gas, the activating gas, or both, with heat generated from said combusting.

2. A method of producing an activated carbon fiber according to claim 1, wherein said preheating heat is generated by combusting the waste gases from both the infusiblizing and activating steps.

3. A method of producing an activated carbon fiber according to claim 1, wherein the activating step is conducted in the presence of steam; the waste activating gas is fed to a separating unit; and the separating step is conducted by cooling the waste activating gas and subjecting the thus cooled waste activating gas to gas-liquid separation whereby a separated liquid is obtained.

4. A method of producing an activated carbon fiber according to claim 3, which further comprises cooling the thus separated liquid and cooling the waste activating gas with the thus cooled, separated liquid.

5. A method of producing an activated carbon fiber according to claim 1, wherein the step (d) the waste gas produced in the infusiblizing step is combusted in the presence of a catalyst.

6. A method of producing an activated carbon fiber according to claim 1, wherein the infusiblizing gas comprises air.

7. A method of producing an activated carbon fiber according to claim 1, wherein the infusiblizing step is carried out at a temperature of from 200 to 500° C.

8. A method of producing an activated carbon fiber according to claim 1, wherein the activating gas comprises steam.

9. A method of producing an activated carbon fiber according to claim 1, wherein the infusiblized fiber is activated at a temperature of from 700 to 1,200° C.

10. A method of producing an activated carbon fiber comprising the steps of:

infusiblizing a pitch fiber with an infusiblizing gas whereby an infusiblized fiber and a waste infusibilizing gas are obtained, activating the infusiblized fiber with an activating gas whereby an activated fiber and a waste activating gas are obtained, removing the waste activating gas to a separating unit, separating by gas-liquid separating means a combustible component and a liquid from the waste activating gas, combusting at least one of the waste gas produced in the infusiblizing step and the combustible component separated in said separating step, preheating at least one of the infusiblizing gas and the activating gas with the heat generated from said combusting, cooling the liquid separated in said separating step whereby a cooled liquid is obtained, and recycling the thus cooled liquid and cooling the waste gas produced in the activating step therewith.

* * * * *